United States Patent [19]

Wayson

[11] 3,991,547

[45] Nov. 16, 1976

[54] EASY PIECE-UP SPINNING RING

[75] Inventor: Andrew John Wayson, Needham, Mass.

[73] Assignee: Litton Industrial Products, Inc., Hingham, Mass.

[22] Filed: Feb. 9, 1976

[21] Appl. No.: 656,365

[52] U.S. Cl. ..... 57/119; 57/122

[51] Int. Cl.[2] ..... D01H 7/64

[58] Field of Search ..... 57/119, 120, 121, 122, 57/125

[56] References Cited

UNITED STATES PATENTS

| | | | |
|---|---|---|---|
| 651,650 | 6/1900 | Campbell et al. | 57/125 |
| 2,198,791 | 4/1940 | Schraff | 57/119 |
| 2,206,591 | 7/1940 | Wentworth | 57/119 |
| 2,533,503 | 12/1950 | Pimley | 57/122 |
| 3,100,374 | 8/1963 | Backus | 57/122 |
| 3,293,841 | 12/1966 | Wayson et al. | 57/120 |
| 3,316,704 | 5/1967 | Wayson | 57/120 |
| 3,332,225 | 7/1967 | Drisch et al. | 57/125 |

*Primary Examiner*—Donald E. Watkins
*Attorney, Agent, or Firm*—Joseph R. Spalla

[57] ABSTRACT

A textile spinning ring for use with a traveler having a yarn-engaging loop extending above a C-shaped ring-engaging traveler body, has means for preventing the yarn from becoming hooked under the traveler body rather than under the loop when the traveler is pieced-up in preparation for spinning. An annular flange configured to conform with the shape of the traveler extends inwardly from the body of the annular ring, the flange presenting a profile lower than the profile of the ring body. A low-profile bridge connects the flange with the ring body, and forms a recess which contains the ends of the traveler body. The flange, bridge and ring body are further configured and dimensioned so that the upper surface of the traveler body is substantially flush with the upper surface of the ring body when the traveler is resting on the flange. When piecing-up the traveler in preparation for spinning, yarn may thus be laid on the upper surface of the ring body, drawn across the upper surface of the traveler body, and hooked under the traveler loop without becoming caught under the traveler body. In an additional embodiment, a segment of the upper surface of the ring body is removed, forming a notch whose upper surface is flush with the recess, allowing piecing-up of a traveler under the ring-engaging traveler body when desired.

9 Claims, 5 Drawing Figures

EASY PIECE-UP SPINNING RING

BACKGROUND

This invention relates to textile spinning and twisting rings. For simplicity in description, only the term spinning ring will be used, but it is understood that this term also encompasses twisting rings.

One type of traveler for spinning textile fibers using a porous metal spinning ring is generally shaped in the form of an open, C-shaped loop, configured to fit over the flange presented by the ring, with the loop opening facing outwardly, away from the bobbin. The traveler is "pieced-up," that is, the yarn is engaged with the traveler in preparation for spinning, by hooking the yarn under the opening in the loop and drawing the yarn up and in until it engages the upper and inner surface of the traveler loop. In this position, the yarn is disposed between the traveler and the ring.

Another type of traveler used for textile spinning also has a generally open, C-shaped ring-engaging body, but in addition has a separate yarn-engaging loop extending above the traveler body which insures that the yarn does not contact the ring.

Some difficulty may be encountered, however, in piecing-up this traveler. In piecing-up any traveler it is convenient to lay the yarn on the ring holder and draw the yarn toward the traveler until it passes through the opening in the yarn-engaging part of the traveler. The yarn is then lifted up to engage the traveler as the yarn continues to be drawn toward the center of the ring. If this piecing-up method is used travelers having a projecting loop however, it often results in piecing-up the yarn between the traveler body and the ring, rather than under the projecting loop.

SUMMARY OF THE INVENTION

A textile spinning ring for use with a traveler having a yarn-engaging loop extending above the C-shaped ring-engaging traveler body has means for preventing the yarn from becoming hooked under the traveler body rather than under the loop when the traveler is pieced-up in preparation for spinning. An annular flange configured to conform with the shape of the traveler extends inwardly from the body of the annular ring, the flange presenting a profile lower than the profile of the ring body. A low-profile bridge connects the flange with the ring body, and forms a recess which contains the ends of the traveler body. The flange, bridge and ring body are further configured and dimensioned so that the upper surface of the traveler body is substantially flush with the upper surface of the ring body when the traveler is resting on the flange. When piecing-up the traveler in preparation for spinning, yarn may thus be laid on the upper surface of the ring body, drawn across the upper surface of the traveler body, and hooked under the traveler loop without becoming caught under the traveler body. In an additional embodiment, a segment of the upper surface of the ring body is removed, forming a notch whose upper surface is flush with the recess, allowing piecing-up of a traveler under the ring-engaging traveler body when desired.

OBJECTS OF THE INVENTION

Accordingly, an object of the invention is in the provision of a ring traveler structure to enable piecing-up of a traveler for textile spinning rings in a convenient fashion.

Another object of the invention is to provide a spinning ring which facilitates piecing-up of its associated traveler.

Still another object of the invention is in the provision of a ring traveler structure to prevent the yarn from catching between the traveler and ring when piecing-up a traveler having a yarn-engaging loop projecting above the traveler body.

A further object of the invention is in the provision of a spinning ring which is designed to accommodate a traveler whereby the surfaces of said ring and traveler, across which yarn is drawn during piecing-up, are coextensive.

Yet another object of the invention is to provide a spinning ring which facilitates piecing-up of a traveler either under the ring-engaging loop or under an upwardly extending yarn-engaging loop, as desired.

Other objects and many of the attendant advantages of this invention will be readily appreciated as the same becomes better understood by reference to the following detailed description when considered in connection with the accompanying drawing in which like reference characters designate like parts throughout the Figures thereof and wherein:

DETAILED DESCRIPTION OF THE INVENTION

Figure 1:
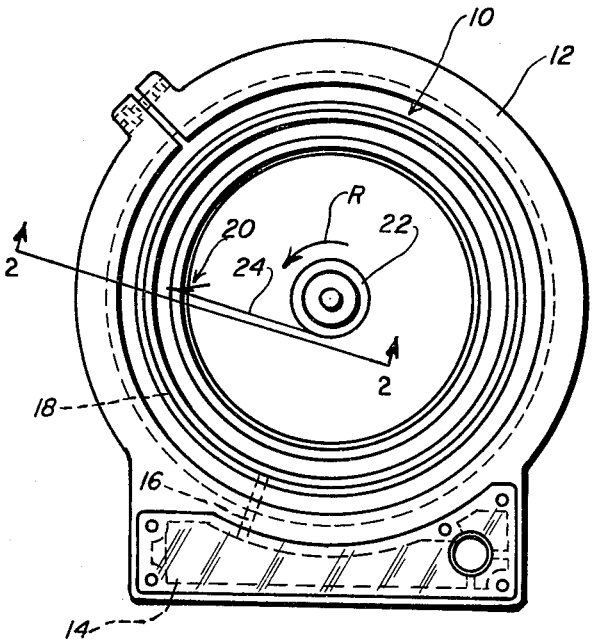
FIG. 1 is a plan view of a textile spinning ring in accordance with the invention.
Figure 3:
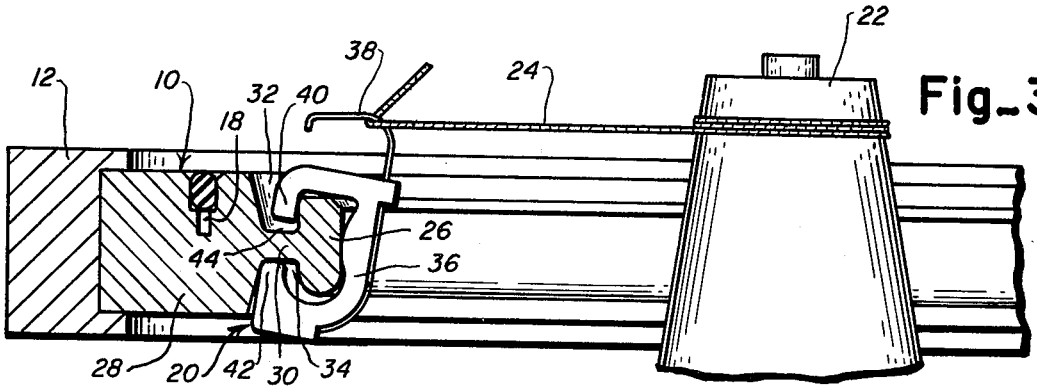
FIG. 3 is a cross-sectional view taken along line 2—2 of FIG. 1 illustrating a traveler in spinning position on an easy piece-up ring.

Referring to FIGS. 1 and 3, a porous metal spinning 10 1p for spinning textile fibers is retained in a ring holder 12 to form an assembly having lubricating means including a lubricant reservoir 14 and lubricant passageway 16 located in holder 12 and a lubricant channel 18 formed in ring 10 for dispensing the lubricant around the ring. Holder 12 and the lubricating means form no part of the invention and may take any convenient form such as those described in my U.S. Pat. Nos. 3,669,219, 3,293,840, 3,107,480, 3,045,417 and 2,926,568.

A traveler generally designated by reference numeral 20 is mounted on ring 10 and a bobbin 22 is located at the center of the ring, supported by means not shown and which form no part of the invention. When spinning, as is conventional in the art, textile fiber or yarn 24 (FIG. 3), which is stored under tension above the bobbin and guided by the traveler 20, is wound on the bobbin 22 as the bobbin 22 rotates in the direction shown by the arrow designated R in FIG. 1. As the bobbin 22 rotates and takes up yarn 24, the yarn 24 pulls the traveler 20 around the ring and the traveler 20 spins or twists the yarn 24 being wound on the bobbin 22.

Figure 2:
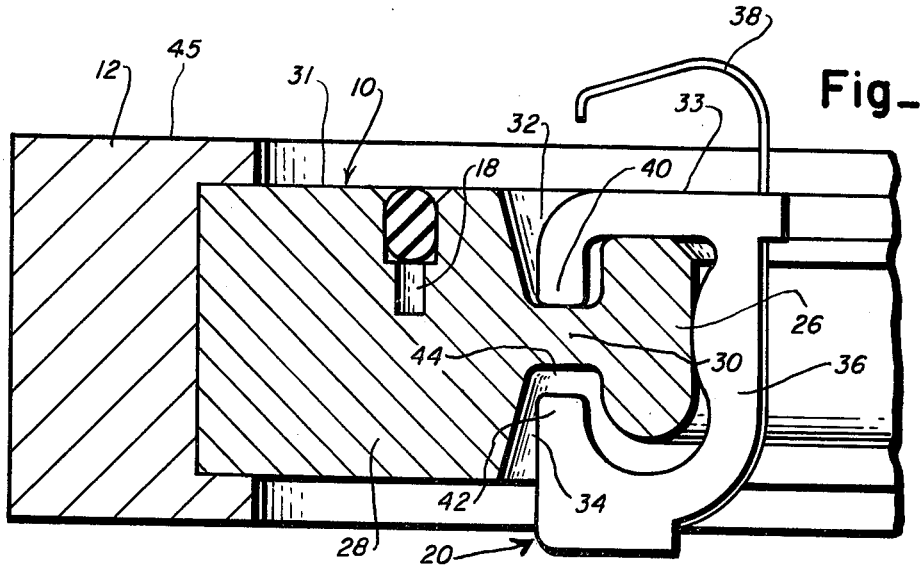
FIG. 2 is a partial cross-sectional view taken along line 2—2 of FIG. 1 illustrating a traveler in rest position on an easy piece-up ring.

Referring now to FIG. 2, traveler 20 is shown resting on ring 10 made in accordance with the invention. Formed integrally with ring 10 is a projecting flange 26 which is joined to a lubrication-channeled body 28 of ring 10 by a bridge 30. Flange 26 is dimensioned and configured to accommodate the cooperating traveler 20, and the height of the flange 26 is lower than the height of ring body 28. The height of bridge 30 is lower than the height of flange 26, providing top and bottom recesses 32, 34 between ring body 28 and flange 26. Additionally, the ring body 28, bridge 30 and flange 26 are so dimensioned and configured as to insure that the upper surface 31 of the ring body 28 is substantially flush with the upper surface 33 of the C-shaped body of a mounted traveler 20 when the traveler is resting on the flange 26.

Traveler 20 may have any convenient configuration, a number of which are known in the art, but generally includes a C-shaped, ring-contacting body 36 and a yarn-engaging loop 38 extending upwardly from the traveler body. Loop 38 may take the form of an open hook facing away from the bobbin, as illustrated in FIG. 2 or may, for example, curve around almost 360° to form a circle with a slight opening, or may face toward the bobbin, or may take a variety of other forms. Ring-contacting traveler body 36 has ends 40, 42 forming an opening 44, and is dimensioned to cooperate with recesses 32, 34 and flange 26 of ring 10 so that the traveler body 36 may be snapped-over the flange and thereby retained on the ring. Traveler body 36 may similarly take a variety of known shapes.

In piecing-up the traveler, the textile machine operator generally grasps the yarn 24 at two points and lays the thus-enclosed portion of the yarn on the upper surface 45 of ring holder 12 between traveler 20 and the outer periphery of holder 12. The yarn is drawn toward the center of the ring, sliding first across holder 12, then across the upper surface 31 of ring body 28, and then the upper surface 33 of body 36 of traveler 20, until the yarn 24 catches on loop 38. The operator then draws the yarn up while continuing to draw it toward the center of the ring, maintaining tension on the yarn until the rotation of the bobbin 22 starts. Due to the positioning of opening 44 of traveler 20 below the upper surface 31 of the ring body 28, with end 40 of the traveler extending into recess 32, piecing-up the yarn 24 under ring-contacting body 36 of the traveler is precluded and piecing-up the yarn under loop 38 without snagging is assured. Piecing-up is also facilitated by positioning of the upper surface 33 of the ring-contacting body 36 of the traveler 20 at approximately the same level as the upper surface 31 of the ring body.

Figure 4:
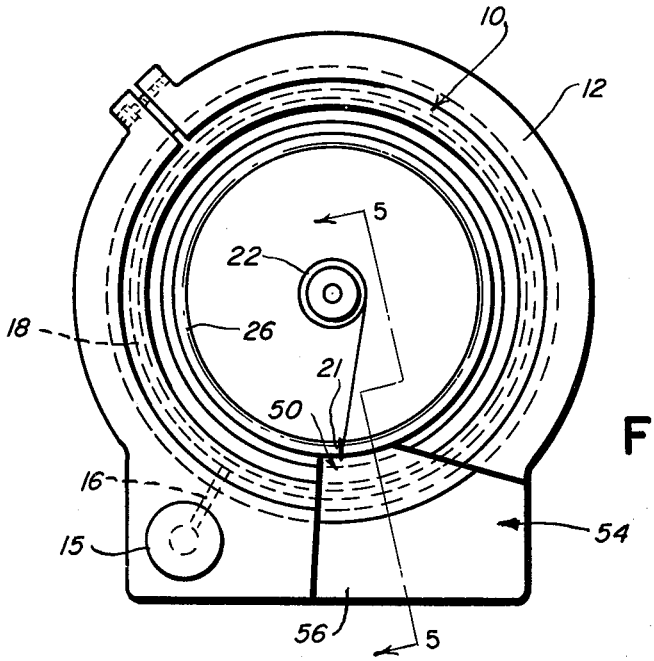
FIG. 4 is a plan view of an additional embodiment of a textile spinning ring in accordance with the invention.
Figure 5:
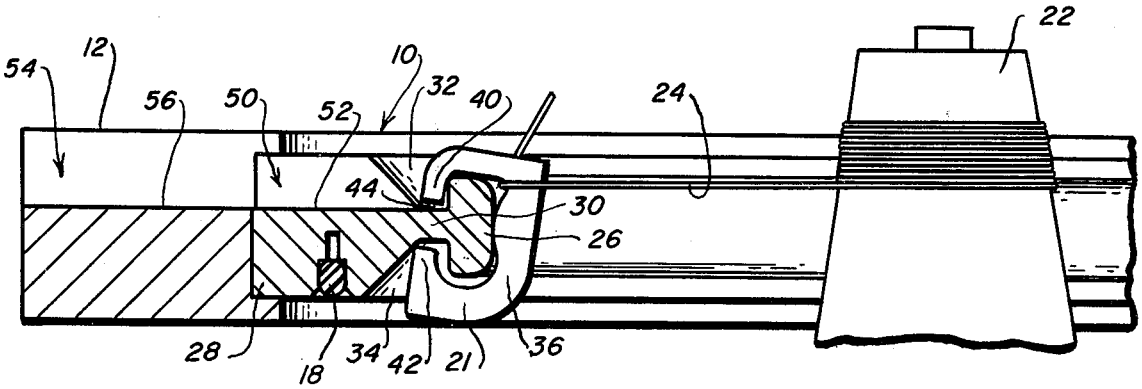
FIG. 5 is a cross-sectional view taken along line 5—5 of FIG. 4 illustrating a ring which allows piecing-up of a traveler under the ring-engaging loop or under an upwardly extending yarn engaging loop, as desired.

Referring now to FIGS. 4 and 5, an additional embodiment of ring 10 of the invention is retained in a ring holder 12 to form an assembly having lubricating means including silo-type lubricant reservoir 15 and lubricant passageway 16 located in holder 12 and a lubricant channel 18 formed in ring 10.

Ring 10, similar to the embodiment of FIGS. 1–3, has a ring body 28 and an inwardly extending flange 26 connected by a reduced cross-section bridge 30 forming upper and lower recesses 32, 34. In the embodiment of FIG. 5, however, a segment of the upper portion of the ring body is removed, forming a notch 50 in the ring body. Notch 50 is cut so that the lower surface 52 of the notch is flush with upper ring recess 32, forming a single, smooth surface between flange 26 and the outer periphery of the ring in the area where notch 50 is formed. Lubricating channel 18 is formed on the underside of the ring body to avoid breaking into the notch. Lubricant is steadily supplied to flange 26 due to the porous nature of the metal of the ring, as is known in the art. In the embodiment of FIG. 5, ring holder 12 is also provided with a cut-away portion 54 forming a recess whose lower surface 56 is flush with lower surface 52 of notch 50. Upper leg 40 of traveler 10 is thus exposed over the removed segment of the ring body and is not contained in recess 32 when the traveler is positioned on this segment of the ring.

Ring 10 of the embodiment of FIG. 5 facilitates piecing-up a traveler under either the ring engaging body 36, as illustrated in FIG. 5, or under a yarn engaging loop extending upwardly from the ring body, as illustrated in FIG. 3. If it is desired to piece-up the former type of traveler, the traveler is positioned on the ring segment where notch 50 is formed, and the yarn 24 is drawn by the machine operator across upper surface 56 of notched segment 54 of ring holder 12, across upper surface 52 of notch 50 in the ring, under upper leg 40 and through opening 44 of the traveler, and then inwardly and upwardly until the yarn engages the upper and inner surface of the inside of C-shaped ring body 36. If it is desired to piece-up a traveler of the type illustrated in FIGS. 2–3, the traveler is positioned around the ring at a point some distance away from notch 50. Piecing-up may then take place as described herein in connection with the embodiment of FIGS. 1–3.

Also, due to the symmetry of flange 26 of ring 10 about a horizontal axis centrally located with respect to the flange, the ring of the embodiment of FIGS. 4–5 may conveniently be flipped over in holder 12 so that notch 50 is located on the underside of the ring and holder assembly. With ring 10 thus positioned, notch 50 is out of the way of piecing-up when it is desired to use a traveler such as depicted in FIG. 2 having an yarn engaging loop 38 extending above the ring engaging traveler body 36. Accidental piecing-up of the yarn under ring engaging traveler body 36 is thus prevented.

The invention claimed is:

1. A porous metal spinning ring for spinning textile fibers adapted to be used in cooperation with a ring holder having a lubricant supply means and a traveler having a textile-engaging loop extending above a generally C-shaped, ring-engaging body, said ring comprising:

an annular ring body adapted to cooperate with said ring holder, said ring body having an annular channel formed therein and adapted to cooperate with said lubricant supply means for dispensing lubricant around the ring, an annular flange extending inwardly from the body of the ring, said flange adapted to support said traveler body, and means on said ring associated with said traveler for preventing textile fibers from becoming hooked under said traveler body when textile fibers are hooked under said traveler loop in preparation for spinning.

2. The ring of claim 1, said flange having a height lower than the height of said ring body.

3. The ring of claim 2, said flange being joined to said ring body by a bridge having a height lower than the height of said flange, thereby providing a recess between said flange and said ring body.

4. The ring of claim 3, said ring body having a flat surface, and said recess and flange heights being dimensioned to mount a traveler so that the flat surface of the traveler body is coextensive with said flat surface of the ring body, whereby a textile fiber resting on said upper surface of the ring body may be readily pulled across said upper surface of the traveler body and pulled upwardly to engage the loop of the traveler.

5. The ring of claim 1, wherein said preventing means on said ring associated with said traveler include means on said ring body.

6. The ring of claim 5, said preventing means on said ring body and said traveler including coextensive surfaces perpendicular to the axis of said ring.

7. The ring of claim 1 further adapted to be used in cooperation with a second traveler having a generally C-shaped ring-engaging body in which yarn engages the ring-engaging body when spinning the textile fibers including means formed on said ring body permitting textile fibers to be hooked under said second traveler body in preparation for spinning.

8. The ring of claim 7 including a notch formed in said ring body, said notch forming a substantially smooth surface extending from the outer periphery of the ring to the annular flange.

9. The ring of claim 8 wherein said flange is symmetrical about a horizontal axis centrally located with respect to said flange.

* * * * *